United States Patent [19]

Quinn et al.

[11] Patent Number: 4,490,143

[45] Date of Patent: Dec. 25, 1984

[54] FEEDING TUBE ASSEMBLY

[75] Inventors: David G. Quinn, Grayslake; Robert B. Edwards, II, Libertyville, both of Ill.

[73] Assignee: Viridian, Inc., Wheeling, Ill.

[21] Appl. No.: 422,565

[22] Filed: Sep. 24, 1982

[51] Int. Cl.[3] ..... A61J 7/00

[52] U.S. Cl. ..... 604/270; 604/283

[58] Field of Search ..... 604/270, 280, 282, 283, 604/164, 93

[56] References Cited

U.S. PATENT DOCUMENTS 1,736,182 11/1929 Wilkens ..... 604/270

1,899,781 2/1933 Twiss ..... 604/270

4,390,017 6/1983 Harrison et al. ..... 604/270

4,410,320 10/1983 Dykstra ..... 604/27

*Primary Examiner*—Stephen C. Pellegrino

*Attorney, Agent, or Firm*—Robert E. Wagner; Linda A. Kuczma

[57] ABSTRACT

A feeding assembly for the administration of fluids to a patient comprising a tube having a rigid bolus near its distal end to facilitate the peristaltic movement of the assembly during insertion. The bolus has openings for fluid flow, said openings are oriented to prevent the tip of a stylet from escaping from the tube assembly to minimize the possibility of injury to a patient during stylet intubation.

9 Claims, 5 Drawing Figures

FEEDING TUBE ASSEMBLY

DESCRIPTION

1. Technical Field

The present invention relates generally to the internal administration of fluids to patients, to detection and treatment of medical complications, and to the decompression of the stomach and duodenum and, in particular, to an improved enteric tube assembly therefor.

2. Background of the Invention

During the medical treatment of some patients, it becomes necessary for a patient to undergo enteric therapy by administering medical preparations and fluid nutrients through a flexible feeding tube having a very small cross sectional diameter. Feeding tubes are usually inserted nasally, but may also be inserted orally. Nasally inserted tubes are commonly referred to as nasogastrointestinal tubes and are inserted into a nostril, guided through the nasopharynx, through the oropharynx and into the esophagus. The tube advances into the patient's stomach or duodenum either by peristaltic movement, i.e., peristaltic intubation, or by the use of an internal guide or stylet, i.e., stylet intubation. The stylet is generally formed from a piece of wire at least as long as the length of the tube, and is usually inserted into the proximal end of the feeding tube prior to introduction into the patient. The person inserting the guide places the tube into the patient's intestinal tract by carefully pushing the tube along the aforementioned path.

Typically, feeding tubes are necessary for patients who are unable to swallow or are having difficulty masticating, but nevertheless have functioning gastrointestinal tracts. These so-called feeding tubes are also used to assess internal functions, detect medical complications, treat medical problems, administer medications and to decompress or reinflate the stomach and duodenum postoperatively to prevent the effect of diminished or complete absence of peristalsis either during or subsequent to surgery.

Recently, prior art feeding tubes have been introduced into the market constructed of either polyurethane or silicone rubber. These materials permit the usage of thinner tube walls per cross sectional diameter yielding functional tubes having French sizes approximately 8 FR. Additionally, these tubes can remain inserted in the patient for longer periods of time due to their decreased size and increased resistance to degradation by gastric acids.

In certain common forms, these prior art tubes possess one of two basic weight containing structures at their distal end. These structures aid in the gravity placement of the tube, the prevention of involuntary regurgitation of the tube and assist in the peristaltic movement of the tube into the gastrointestinal tract.

The weights are generally positioned in either of the following manners. In the first version, an elongated bullet-shaped tip, sufficiently larger in cross sectional diameter than the tubing, and filled with liquid mercury, is located at the distal end of the tube. This configuration provides maximum weight and a sizeable protrusion which facilitates peristaltic intubation. However, since voluntary peristaltic action must be initiated by swallowing, stylet intubation is required for unconscious patients. Fluids conducted through the tube exit the tube through apertures in the tube wall positioned proximal to the tip.

To ensure safe placement of the tube in the stomach or duodenum during stylet intubation, the stylet must be properly inserted in the enclosed space between the aperture closest to the distal end of the tube and the end of the tube lumen.

However, the major disadvantages encountered with the above-described prior art tube are the discomfort and insertion difficulties associated with the initial passage of the blunt ended tip into the nasal passage and through the pharynx, and the risk of internal injury to the patient should a stylet exit the tube through an outlet during stylet intubation.

The second prior art version possesses a weighted slenderized tip, containing mercury, which is of the same cross sectional diameter as the tube itself. This slenderized configuration alleviates the problems encountered with the insertion of the bullet-shaped tip discussed above. This slenderized tube has several apertures near its distal end and requires stylet intubation since the smooth even-diametered tube and tip shapes provide no protrubances necessary for implementing peristaltic action. Therefore, despite the weighted distal end, the patient remains unable to aid the progression of the tube by swallowing and passage from the stomach to the duodenum by peristalsis is impeded, further inhibiting the effectiveness of this type of tube.

Hence, a need existed for a feeding tube which could be inserted with minimal discomfort to the patient and without the risks commonly associated with stylet intubation.

SUMMARY OF THE INVENTION

According to the present invention, a feeding tube assembly for the administration of fluids to patients, detection and treatment of medical complications and decompression of stomach and duodenum of a patient, has been developed which provides for a new tube shape, thereby alleviating the difficulty of insertion, the discomfort experienced by the patient, particularly during nasal insertion, and the risks presented during insertion of prior art tube assemblies.

Generally, the present invention embodies a feeding assembly comprised of a flexible tube with an internally weighted guide tip located at the distal end. The guide tip has the same, or slightly less cross sectional diameter than the cross sectional diameter of the tube. The guide tip is designed for simpler and less painful intubation of patients as will be later explained. Cylindrical tungsten segments, or segments of similar material, provide the necessary weight and rigidity for insertion. The tungsten contained in the guide tip is non-toxic to the patient and resistant to degradation by gastric acids.

The distal portion of the tube contains a bead-like bolus located proximal to the guide tip and made from essentially inert plastic or like material. Unlike prior art assemblies, the bolus, rather than the tube, contains lateral apertures which permit the release or passage of fluids from the tube. Additionally, the bolus provides a rigid housing for the distal end of the stylet permitting safe placement of the tube during stylet intubation. Due to its location behind the guide tip, the bolus passes easily and without discomfort through the nasal passages.

The present invention is further described and disclosed through a preferred embodiment presented in the drawings and set forth below in the written description.

DETAILED DESCRIPTION

Figure 1:
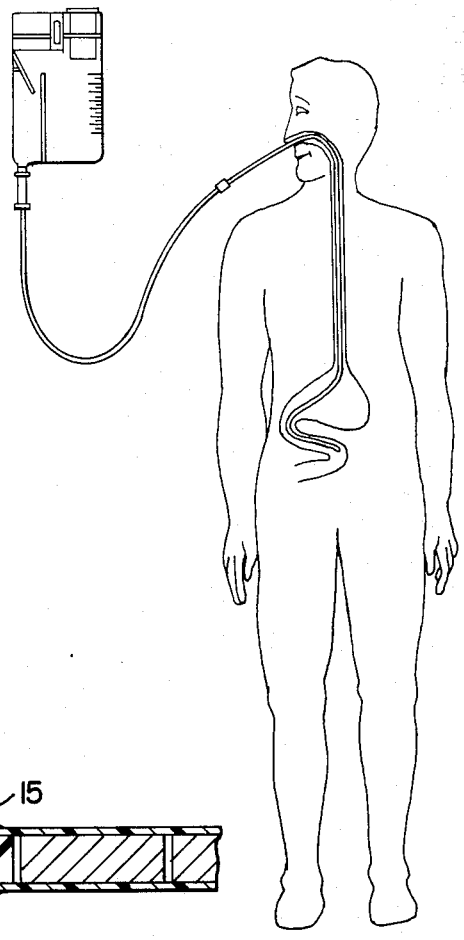
FIG. 1 is an illustrative diagram showing the placement and insertion of the subject invention in combination with an enteric feeding bag.

Referring now to the drawings, FIG. 1 illustrates the insertion path and placement of a feeding assembly of the present invention. More specifically, FIG. 1 illustrates the nasal insertion of the feeding assembly invention, said feeding assembly shown in combination with an enteric feeding bag. Subsequent to insertion of the feeding assembly into the nasal cavity of the patient, the feeding assembly passes through the back of the throat or pharynx of the patient, into the esophagus. Peristaltic action or insertion with a stylet progresses the feeding assembly to the desired location, usually the stomach, or the duodenum, more commonly known as the intestinal tract.

Figure 2:
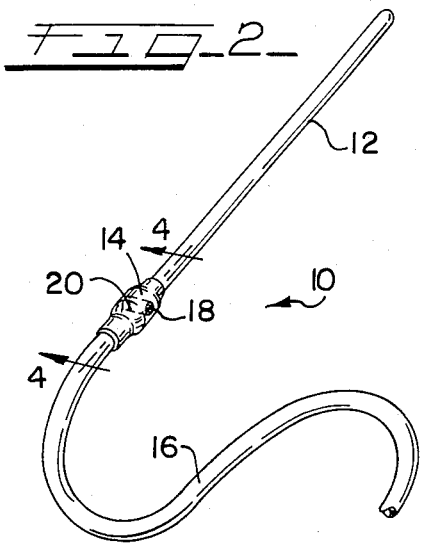
FIG. 2 is a detailed perspective view of the present invention illustrating the preferred guide tip and irrigation or aspiration means.

FIG. 2 illustrates the feeding tube assembly of the present invention generally referenced by the numeral 10. Feeding tube assembly 10 is of a linear tubular shape generally used in the art, and includes a guide tip 12 and hollow tube 16 which are manufactured from polyurethane or silicone rubber. Assembly 10 further includes a smooth, contoured partially hollow bolus 14 having openings 18 and 20 to allow for the selective exit or entry of fluids into hollow tube 16. The bolus 14 is located between the guide tip 12 and tube 16 and is made of a rigid but somewhat compliant plastic or similar material. The bolus 14 possesses a larger cross-sectional diameter than the cross-sectional diameter of tube 16. This increased cross-sectional diameter provides a necessary protrubance for peristaltic action to occur, thereby facilitating peristaltic intubation of a patient.

Figure 3:
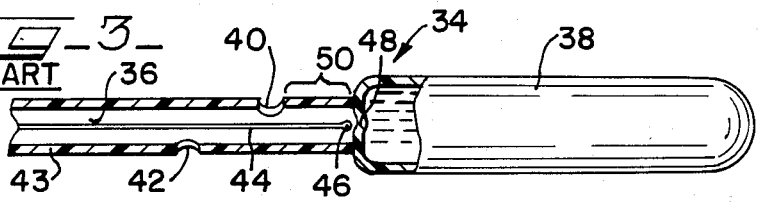
FIG. 3 PRIOR ART
FIG. 3 is a detailed cross sectional fragmentary view of a large tipped feeding tube assembly known in the art.

FIG. 3 illustrates a feeding tube assembly used in the art and generally referenced by the numeral 34. A brief explanation of prior art tubes will make evident that the present invention represents an improvement over such prior art feeding tubes having large diameter guide tips and/or apertures near the distal end of the tube. Feeding assembly 34 includes a tube 36 and an elongated tip 38. Tube 36 possesses staggered apertures exemplified by 40 and 42 in the tube wall 43. The apertures 40 and 42 allow for the exit of fluids from the tube 36. Apertures 40, 42 weaken the tube wall 43, thereby increasing the likelihood of the tube walls collapsing, twisting or bending and interfering with the regular flow or intake of fluids and/or the progression of tube 34 during insertion. The absence of apertures in the feeding tube 16 of the present invention strengthens and increases the rigidity of the tube walls, decreasing the probability of a tube folding or kinking. In addition, the absence of tubal apertures in the present invention eliminates injury to the patient by minimizing the possibility of escape of the stylet through the tube walls during stylet intubation.

Tip 38 is of a generally tubular shape and possesses a cross sectional diameter substantially larger than the cross sectional diameter of tube 36. Due to its increased size, tip 38 causes the patient to experience varying degrees of pain during insertion. Tip 38 contains liquid mercury to increase the gravitational effect during insertion of the feeding assembly 34. Stylet 44 shown inserted in tube 36 is used to introduce and guide feeding assembly 34 through the nasal passages and into the gastrointestinal tract when peristatltic intubation is not feasible. Stylet 44 is a thin wire with a spherical bead 46 located at its distal end. Located at the proximal end of tip 38 is a receiving pocket 48. The receiving pocket 48 seeks to aid in the proper placement of the spherical bead 46 and is designed to attempt to prevent the stylet 44 from exiting the aperture 40 and 42 found in the tube 36. A pocket 50 is formed in the tube 36 thereby accumulating fluids and preventing such fluids from exiting the tube 36 from either apertures 40, 42.

Figure 4:
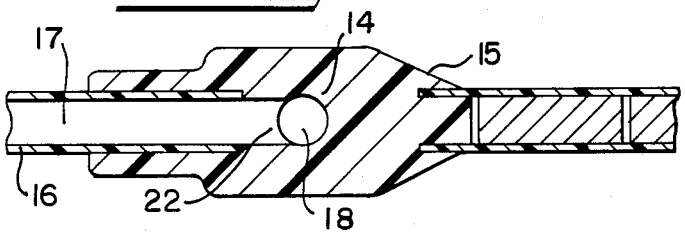
FIG. 4 is a detailed vertical cross sectional fragmentary view of the distal end of the tube assembly taken along line 3—3 in FIG. 2, including part of the guide tip, and bolus; and, FIG. 5 is a detailed horizontal cross sectional fragmentary view of the distal end of the tube assembly shown in FIG. 4.
Figure 5:
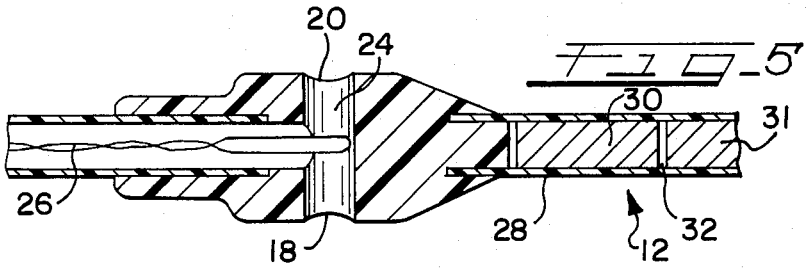

In contrast to the prior art, FIGS. 4 and 5 disclose the novel structure of feeding assembly 10 of the present invention. The tube 16 is connected to the bolus 14 with the distal end of tube 16 being inserted into an axial opening in bolus 14 and suitably sealed therein. A cylindrical channel 22 is formed at the distal end of the tube 16 within the bolus 14 in axial alignment with tube 16. A transverse cylindrical channel 24 located in bolus 14 lies perpendicular to and is in fluid communication with the cylindrical channel 22 forming a hollow "T" formation in bolus 14 allowing fluid passing through tube lumen 17 to exit the bolus 14 at openings 18 and 20; tube lumen 17 being the tubular cavity defined by the walls of tube 16.

The perpendicular relationship between channels 22, 24 of the bolus 14 eliminates the possibility of any accumulation or storage of fluids and ensures that all fluid is dispensed into the gastrointestinal tract. Since the progression of any inserted stylet, including the prior art form 44 previously discussed and an improved stylet 26 shown in FIG. 5, will be impeded by the top of the "T" formation and held within the rigid structure of bolus 14, the "T" formation in the bolus 14 inhibits the stylets 26, 44 from exiting channel 24. The possibility of internal injury to the patient by the stylets is minimized because the stylets 26, 44 would have to bend through an angle of 90° to exit the bolus 14 through openings 18, 20. In addition, should peristaltic insertion of the feeding assembly 10 become difficult at any time, a stylet 26, 44 may be introduced into the tube lumen 17, after feeding assembly 10 has been partially inserted into the patient, without fear of injury to the patient caused by the escape of the stylet from apertures such as 40,42 found in prior art tubes. Preferably, to facilitate the exit of fluids from the tube 16, the diameter of channel 24 is larger than the diameter of the tube lumen 17.

FIG. 5 illustrates a stylet 26 inserted into the tube lumen 17, which is used to guide the feeding tube assembly 10 during insertion and aid proper placement of the feeding tube assembly 10. The stylet 26 usually is of a length greater than or equal to the length of tube 16 and is inserted into the proximal end of tube lumen 17 prior to insertion of the tube 16 into the patient. Stylet intubation of a patient is necessary whenever a patient is unable to aid the progression of the tube by swallowing or voluntary peristaltic movement.

The stylet 26 shown in FIG. 5 is an improvement over the prior art stylet 44 and is the subject of a separate patent application entitled Improved Feeding Tube Stylet, Ser. No. 422,564, filed on Sept. 24, 1982, in the names of Robert B. Edwards II and David MacLean.

Guide tip 12 is of a generally tubular shape and possesses a diameter smaller than the diameter of the bolus 14. Preferably, guide tip 12 possesses a diameter which is less than or equal to the diameter of tube 16. The portion of bolus 14 distal to channel 24 is smoothly and gradually tapered to the diameter of guide tip 12. This tapered design 15, in combination with the slenderized configuration of guide tip 12 alleviates the discomfort and pain experienced by patients during insertion of large-tipped prior art tubes (see FIG. 3). Unlike the insertion of large-tipped prior art tubes, guide tip 12 gently parts nasal tissues and more easily slips through confined internal passages along its route into the gastrointestinal tract of a patient. Additionally, the slenderized design of guide tip 12 prepares a path for the larger diametered bolus 14 to follow, thereby alleviating patient discomfort. Progression of the bolus 14 and tube 16 is further facilitated by the tapered distal end of bolus 14.

The tubular walls 28 of guide tip 12 encase cylindrical, rod-like segments 30 of a solid material which aids in the gravity placement of tube assembly 10, prevention of involuntary regurgitation of tube assembly 10, and assists in the peristaltic movement of the tube assembly 10 into the gastrointestinal tract. Preferably, the cylindrical segments 30, 31 are composed of tungsten or a similar material which is non-toxic and essentially inert internally. The cylindrical segments 30, 31 are positioned in spaced relation with guide tip 12, and form layers of vacant space 32 between each segment. The vacant space 32 between each cylindrical segment 30, 31 enables the guide tip 12 to be flexible while simultaneously retaining some degree of rigidity. The perpendicular relationship between channels 22 and 24 of bolus 14 eliminates any accumulation or storage of fluids and ensures that all fluid is dispensed into the gastrointestinal tract.

While the invention has been described with reference to a preferred embodiment, it will be understood by those in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to a particular embodiment disclosed as the best mode contemplated for carrying out the invention, but that the invention will include all embodiments falling within the scope of the appended claims.

We claim:

1. A feeding assembly having a flexible tube of predetermined diameter for selective enteric administration and aspiration of fluids to and from the gastrointestinal tract of a patient, the tube having a proximal end joined to an enteric feeding bag, and a distal end, comprising in combination:

a non-collapsible bolus positioned at the distal end of said tube, said bolus having a tapered frustoconical distal end and a tapered proximal end, said bolus having its largest diameter between said proximal and distal portions, said bolus having a diameter greater than the diameter of said tube, said bolus also having a first internal channel in fluid communication with said tube, said bolus possessing at least one outside opening in fluid communication with said first channel whereby said tube and said bolus can selectively accommodate fluids introduced thereto from said bag to exit said bolus for enteric feeding and through said tube and said bolus to facilitate aspiration of fluids from the gastrointestinal tract of a patient; and an elongated weighted guide tip located distal to said bolus, said guide tip having a diameter less than the diameter of said bolus.

2. The feeding assembly described in claim 1, wherein said bolus has a second internal channel transverse to and in fluid communication with said first channel, said first channel terminating in said second channel, and, said second channel having oppositely facing outside openings.

3. The feeding assembly described in claim 2, wherein the said second channel is perpendicular to and in fluid communication with said first channel.

4. The feeding assembly described in claim 1, wherein the portion of said bolus distal to said second channel is tapered to the diameter of said guide tip.

5. The feeding assembly described in claim 2, wherein the diameter of said second channel is greater than or equal to the internal diameter of said tube.

6. The feeding assembly described in claim 1, wherein said guide tip has a diameter less than or equal to the diameter of said tube.

7. The feeding assembly described in claim 1, wherein said guide tip encases cylindrical rod-like segments of a non-toxic, relatively dense and internally inert material.

8. The feeding assembly described in claim 7, wherein said guide tip encases cylindrical rod-like segments of tungsten.

9. A feeding assembly having a flexible tube of predetermined diameter for selective enteric administration and aspiration of fluids to and from the gastrointestinal tract of a patient, the tube having a proximal end joined to an enteric feeding bag, and a distal end, comprising in combination:

a non-collapsible bolus positioned at the distal end of said tube, said bolus having a tapered frustoconical distal end and a tapered proximal end, said bolus having its largest diameter between said proximal and distal portions, said bolus having a diameter greater than the diameter of said tube, said bolus having a first internal channel in fluid communication with said tube, said bolus having a second internal channel extending transversely to and in fluid communication with said first channel, said first channel terminating in said second channel, said second channel having oppositely faced outside openings, said second channel having a diameter at least as large as the internal diameter of said tube, the portion of said bolus distal to said second channel being tapered to the diameter of said guide tip; and an elongated weighted guide tip located distal to said bolus, said guide tip having a diameter less than or equal to the diameter of said tube, said guide tip encasing non-toxic rod-like weighted segments.

* * * * *